US011741898B1

(12) United States Patent
Klement et al.

(10) Patent No.: US 11,741,898 B1
(45) Date of Patent: Aug. 29, 2023

(54) POWER MANAGEMENT FOR GLOBAL MODE DISPLAY PANEL ILLUMINATION

(71) Applicant: Meta Platforms Technologies, LLC, Menlo Park, CA (US)

(72) Inventors: Alexander Klement, Kenmore, WA (US); Aaron Jacob Steyskal, Redmond, WA (US); Donghee Nam, San Jose, CA (US); Wenhao Qiao, Milpitas, CA (US); Wonjae Choi, San Jose, CA (US)

(73) Assignee: Meta Platforms Technologies, LLC, Menlo Park, CA (US)

( * ) Notice: Subject to any disclaimer, the term of this patent is extended or adjusted under 35 U.S.C. 154(b) by 0 days.

(21) Appl. No.: 17/738,830

(22) Filed: May 6, 2022

(51) Int. Cl.
*G09G 3/3233* (2016.01)
*G09G 3/3258* (2016.01)
*G09G 3/00* (2006.01)

(52) U.S. Cl.
CPC ..... *G09G 3/3233* (2013.01); *G09G 3/002* (2013.01); *G09G 2320/0693* (2013.01); *G09G 2330/021* (2013.01)

(58) Field of Classification Search
CPC ..... G02B 27/01; G02B 27/017; G09G 3/32; G09G 3/3233; G09G 3/002; G09G 2300/0866; G09G 2320/0223; G09G 2320/0276; G09G 2320/0693; G09G 2320/08; G09G 2330/02; G09G 2330/021; G09G 2360/16; G09G 3/2092; G09G 3/3258; G09G 3/3275; G09G 2310/08
See application file for complete search history.

(56) References Cited

U.S. PATENT DOCUMENTS

2014/0062989 A1* 3/2014 Ebisuno ..... G09G 3/3225 345/212
2017/0061860 A1* 3/2017 Park ..... G09G 3/3648
2020/0066207 A1* 2/2020 Gu ..... G09G 3/3266

* cited by examiner

*Primary Examiner* — Xuemei Zheng
(74) *Attorney, Agent, or Firm* — Fenwick & West LLP

(57) ABSTRACT

A power supply unit adapts based on an image to be displayed by a display panel. The power supply unit includes a controller circuit for generating a power control signal, and a power supply circuit for generating one or more power supply voltages having a waveform based the power control signal. The controller circuit receives a set of configuration parameters from a display device and generates the power control signal based on the set of configuration parameters. The configuration parameters are stored in a look-up table of the display device.

20 Claims, 11 Drawing Sheets

LUT Entry
810

| Time | AVDD | ELVDD | ELVSS |
|---|---|---|---|
| 0 | 0% | 0% | 0% |
| 3.3 usec | 0% | 0% | 0% |
| 3.4 usec | +3.0% | +1.5% | +2.0% |
| 3.5 usec | +2.0% | +1.0% | +1.3% |
| 3.6 usec | +1.0% | +0.5% | +0.4% |
| 3.7 usec | 0% | 0% | 0% |

LUT Entry
810

| Time | AVDD | ELVDD | ELVSS |
|---|---|---|---|
| 0 | 0% | 0% | 0% |
| 3.3 usec | 0% | 0% | 0% |
| 3.4 usec | +3.0% | +1.5% | +2.0% |
| 3.5 usec | +2.0% | +1.0% | +1.3% |
| 3.6 usec | +1.0% | +0.5% | +0.4% |
| 3.7 usec | 0% | 0% | 0% |

POWER MANAGEMENT FOR GLOBAL MODE DISPLAY PANEL ILLUMINATION

FIELD OF THE INVENTION

This disclosure relates generally to a power supply circuit, and more specifically to an adaptive power supply circuit based on an image to be displayed on a display panel.

BACKGROUND

The amount of power consumed by a display device may depend on the average brightness of an image being displayed. As such, as the average brightness of display frames change, the power consumption of the display device fluctuates accordingly. Moreover, when a display device is operated in a global illumination mode (where every pixel is illuminated concurrently), large spikes in power consumption may occur when the pixels are activated, especially when bright images or images containing large amount of white pixels are being displayed by the display device. These spikes in power consumption may cause visual artifacts to appear in the display device.

SUMMARY

Embodiments relate to a power management circuit that receives an input supply voltage (e.g., from a power outlet or a battery) and generates an output supply voltage to power a display device where the operation of the power management circuit is controlled based on the display data of the image to be displayed by the display device.

In one or more embodiments, the power supply unit adapts based on an image to be displayed by a display panel. The power supply unit includes a controller circuit for generating a power control signal, and a power supply circuit for generating one or more power supply voltages having a waveform based the power control signal. The controller circuit receives a set of configuration parameters from a display device and generates the power control signal based on the set of configuration parameters. The configuration parameters are stored in a look-up table of the display device. Alternatively, the configuration parameters are stored as an equation (or coefficients for a predefined equation) in a non-volatile memory of the display device.

The figures depict various embodiments for purposes of illustration only. One skilled in the art will readily recognize from the following discussion that alternative embodiments of the structures and methods illustrated herein may be employed without departing from the principles described herein.

DETAILED DESCRIPTION

Embodiments of the invention may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to create content in an artificial reality and/or are otherwise used in an artificial reality. The artificial reality system that provides the artificial reality content may be implemented on various platforms, including a wearable device (e.g., headset) connected to a host computer system, a standalone wearable device (e.g., headset), a mobile device or computing system, or any other hardware platform capable of providing artificial reality content to one or more viewers.

Figure 1A:
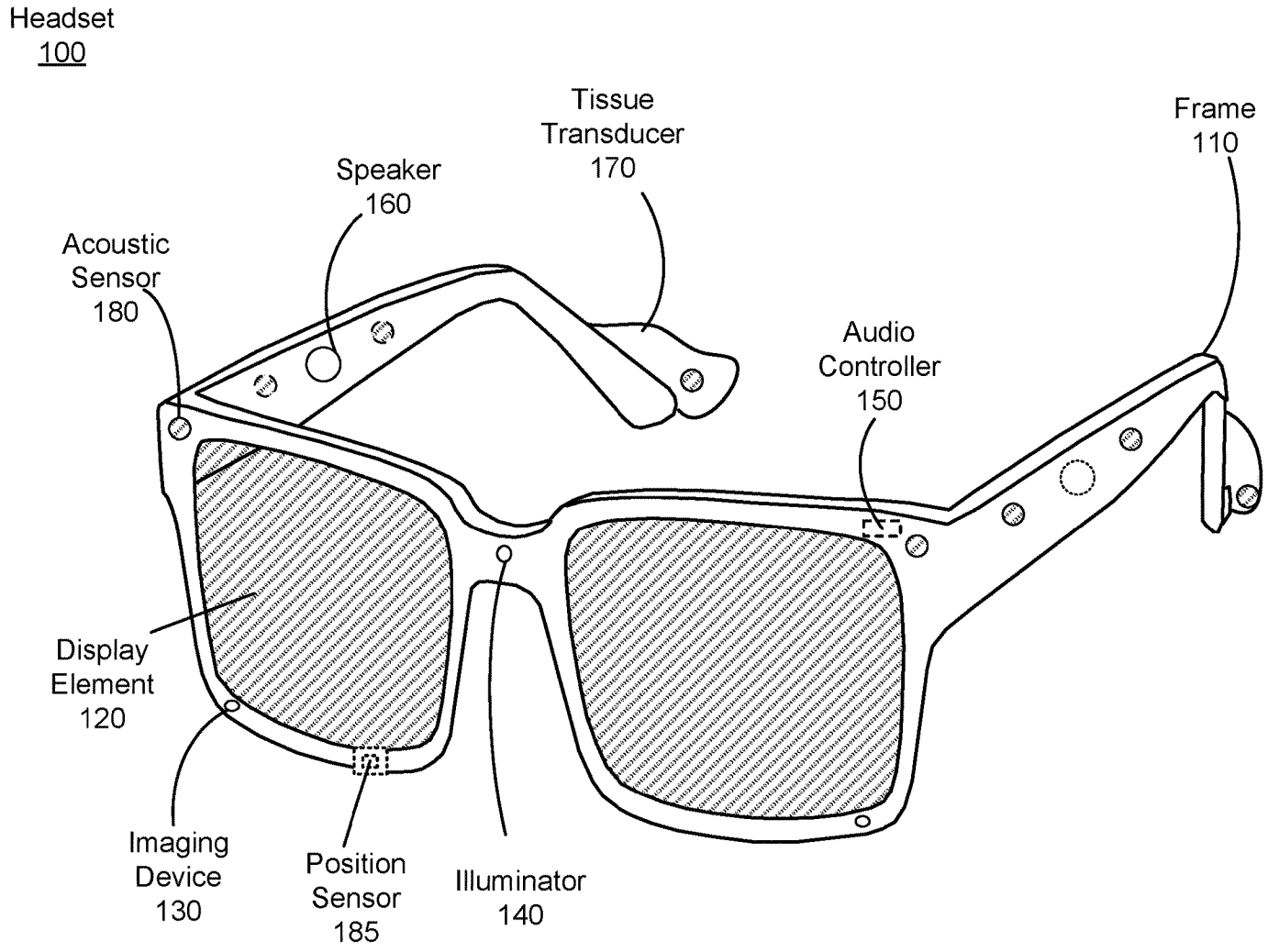
FIG. 1A is a perspective view of a headset implemented as an eyewear device, according to one or more embodiments.

FIG. 1A is a perspective view of a headset 100 implemented as an eyewear device, according to one or more embodiments. In some embodiments, the eyewear device is a near eye display (NED). In general, the headset 100 may be worn on the face of a user such that content (e.g., media content) is presented using a display assembly and/or an audio system. However, the headset 100 may also be used such that media content is presented to a user in a different manner. Examples of media content presented by the headset 100 include one or more images, video, audio, or some combination thereof. The headset 100 includes a frame, and may include, among other components, a display assembly including one or more display elements 120, a depth camera assembly (DCA), an audio system, and a position sensor 185. While FIG. 1A illustrates the components of the headset 100 in example locations on the headset 100, the components may be located elsewhere on the headset 100, on a peripheral device paired with the headset 100, or some combination thereof. Similarly, there may be more or fewer components on the headset 100 than what is shown in FIG. 1A.

The frame 110 holds the other components of the headset 100. The frame 110 includes a front part that holds the one or more display elements 120 and end pieces (e.g., temples) to attach to a head of the user. The front part of the frame 110 bridges the top of a nose of the user. The length of the end pieces may be adjustable (e.g., adjustable temple length) to fit different users. The end pieces may also include a portion that curls behind the ear of the user (e.g., temple tip, ear piece).

The one or more display elements 120 provide light to a user wearing the headset 100. As illustrated the headset includes a display element 120 for each eye of a user. In some embodiments, a display element 120 generates image light that is provided to an eyebox of the headset 100. The eyebox is a location in space that an eye of user occupies while wearing the headset 100. For example, a display element 120 may be a waveguide display. A waveguide display includes a light source (e.g., a two-dimensional source, one or more line sources, one or more point sources, etc.) and one or more waveguides. Light from the light source is in-coupled into the one or more waveguides which outputs the light in a manner such that there is pupil replication in an eyebox of the headset 100. In-coupling and/or outcoupling of light from the one or more waveguides may be done using one or more diffraction gratings. In some embodiments, the waveguide display includes a scanning element (e.g., waveguide, mirror, etc.) that scans light from the light source as it is in-coupled into the one or more waveguides. Note that in some embodiments, one or both of the display elements 120 are opaque and do not transmit light from a local area around the headset 100. The local area is the area surrounding the headset 100. For example, the local area may be a room that a user wearing the headset 100 is inside, or the user wearing the headset 100 may be outside and the local area is an outside area. In this context, the headset 100 generates VR content. Alternatively, in some embodiments, one or both of the display elements 120 are at least partially transparent, such that light from the local area may be combined with light from the one or more display elements to produce AR and/or MR content.

In some embodiments, a display element 120 does not generate image light, and instead is a lens that transmits light from the local area to the eyebox. For example, one or both of the display elements 120 may be a lens without correction (non-prescription) or a prescription lens (e.g., single vision, bifocal and trifocal, or progressive) to help correct for defects in a user's eyesight. In some embodiments, the display element 120 may be polarized and/or tinted to protect the user's eyes from the sun.

In some embodiments, the display element 120 may include an additional optics block (not shown). The optics block may include one or more optical elements (e.g., lens, Fresnel lens, etc.) that direct light from the display element 120 to the eyebox. The optics block may, e.g., correct for aberrations in some or all of the image content, magnify some or all of the image, or some combination thereof.

The DCA determines depth information for a portion of a local area surrounding the headset 100. The DCA includes one or more imaging devices 130 and a DCA controller (not shown in FIG. 1A), and may also include an illuminator 140. In some embodiments, the illuminator 140 illuminates a portion of the local area with light. The light may be, e.g., structured light (e.g., dot pattern, bars, etc.) in the infrared (IR), IR flash for time-of-flight, etc. In some embodiments, the one or more imaging devices 130 capture images of the portion of the local area that include the light from the illuminator 140. As illustrated, FIG. 1A shows a single illuminator 140 and two imaging devices 130. In alternate embodiments, there is no illuminator 140 and at least two imaging devices 130.

The DCA controller computes depth information for the portion of the local area using the captured images and one or more depth determination techniques. The depth determination technique may be, e.g., direct time-of-flight (ToF) depth sensing, indirect ToF depth sensing, structured light, passive stereo analysis, active stereo analysis (uses texture added to the scene by light from the illuminator 140), some other technique to determine depth of a scene, or some combination thereof.

The DCA may include an eye tracking unit that determines eye tracking information. The eye tracking information may comprise information about a position and an orientation of one or both eyes (within their respective eye-boxes). The eye tracking unit may include one or more cameras. The eye tracking unit estimates an angular orientation of one or both eyes based on images captures of one or both eyes by the one or more cameras. In some embodiments, the eye tracking unit may also include one or more illuminators that illuminate one or both eyes with an illumination pattern (e.g., structured light, glints, etc.). The eye tracking unit may use the illumination pattern in the captured images to determine the eye tracking information. The headset 100 may prompt the user to opt in to allow operation of the eye tracking unit. For example, by opting in the headset 100 may detect, store, images of the user's any or eye tracking information of the user.

The audio system provides audio content. The audio system includes a transducer array, a sensor array, and an audio controller 150. However, in other embodiments, the audio system may include different and/or additional components. Similarly, in some cases, functionality described with reference to the components of the audio system can be distributed among the components in a different manner than is described here. For example, some or all of the functions of the controller may be performed by a remote server.

The transducer array presents sound to user. The transducer array includes a plurality of transducers. A transducer may be a speaker 160 or a tissue transducer 170 (e.g., a bone conduction transducer or a cartilage conduction transducer). Although the speakers 160 are shown exterior to the frame 110, the speakers 160 may be enclosed in the frame 110. In some embodiments, instead of individual speakers for each ear, the headset 100 includes a speaker array comprising multiple speakers integrated into the frame 110 to improve directionality of presented audio content. The tissue transducer 170 couples to the head of the user and directly vibrates tissue (e.g., bone or cartilage) of the user to generate sound. The number and/or locations of transducers may be different from what is shown in FIG. 1A.

The sensor array detects sounds within the local area of the headset 100. The sensor array includes a plurality of acoustic sensors 180. An acoustic sensor 180 captures sounds emitted from one or more sound sources in the local area (e.g., a room). Each acoustic sensor is configured to detect sound and convert the detected sound into an electronic format (analog or digital). The acoustic sensors 180 may be acoustic wave sensors, microphones, sound transducers, or similar sensors that are suitable for detecting sounds.

In some embodiments, one or more acoustic sensors 180 may be placed in an ear canal of each ear (e.g., acting as binaural microphones). In some embodiments, the acoustic sensors 180 may be placed on an exterior surface of the headset 100, placed on an interior surface of the headset 100, separate from the headset 100 (e.g., part of some other device), or some combination thereof. The number and/or locations of acoustic sensors 180 may be different from what is shown in FIG. 1A. For example, the number of acoustic detection locations may be increased to increase the amount of audio information collected and the sensitivity and/or accuracy of the information. The acoustic detection locations may be oriented such that the microphone is able to detect sounds in a wide range of directions surrounding the user wearing the headset 100.

The audio controller 150 processes information from the sensor array that describes sounds detected by the sensor array. The audio controller 150 may comprise a processor and a computer-readable storage medium. The audio controller 150 may be configured to generate direction of arrival (DOA) estimates, generate acoustic transfer functions (e.g., array transfer functions and/or head-related transfer functions), track the location of sound sources, form beams in the direction of sound sources, classify sound sources, generate sound filters for the speakers 160, or some combination thereof.

The position sensor 185 generates one or more measurement signals in response to motion of the headset 100. The position sensor 185 may be located on a portion of the frame 110 of the headset 100. The position sensor 185 may include an inertial measurement unit (IMU). Examples of position sensor 185 include: one or more accelerometers, one or more gyroscopes, one or more magnetometers, another suitable type of sensor that detects motion, a type of sensor used for error correction of the IMU, or some combination thereof. The position sensor 185 may be located external to the IMU, internal to the IMU, or some combination thereof.

In some embodiments, the headset 100 may provide for simultaneous localization and mapping (SLAM) for a position of the headset 100 and updating of a model of the local area. For example, the headset 100 may include a passive camera assembly (PCA) that generates color image data. The PCA may include one or more RGB cameras that capture images of some or all of the local area. In some embodiments, some or all of the imaging devices 130 of the DCA may also function as the PCA. The images captured by the PCA and the depth information determined by the DCA may be used to determine parameters of the local area, generate a model of the local area, update a model of the local area, or some combination thereof. Furthermore, the position sensor 185 tracks the position (e.g., location and pose) of the headset 100 within the room. Additional details regarding the components of the headset 100 are discussed below in connection with FIG. 9.

Figure 1B:
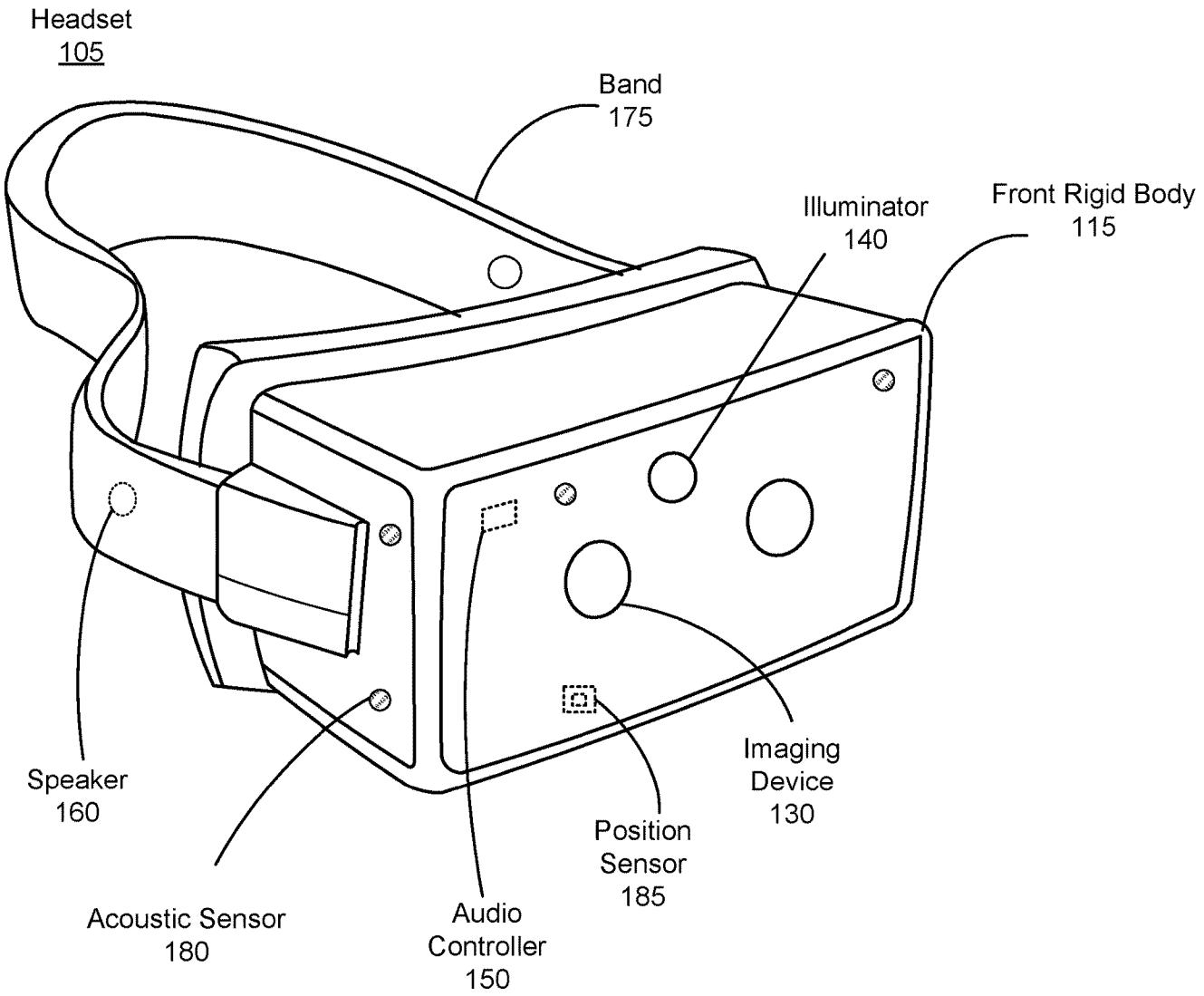
FIG. 1B is a perspective view of a headset implemented as a head-mounted display, according to one or more embodiments.

FIG. 1B is a perspective view of a headset 105 implemented as a HMD, according to according to one or more embodiments. In embodiments that describe an AR system and/or a MR system, portions of a front side of the HMD are at least partially transparent in the visible band (~380 nm to 750 nm), and portions of the HMD that are between the front side of the HMD and an eye of the user are at least partially transparent (e.g., a partially transparent electronic display). The HMD includes a front rigid body 115 and a band 175. The headset 105 includes many of the same components described above with reference to FIG. 1A, but modified to integrate with the HMD form factor. For example, the HMD includes a display assembly, a DCA, an audio system, and a position sensor 185. FIG. 1B shows the illuminator 140, a plurality of the speakers 160, a plurality of the imaging devices 130, a plurality of acoustic sensors 180, and the position sensor 185. The speakers 160 may be located in various locations, such as coupled to the band 175 (as shown), coupled to front rigid body 115, or may be configured to be inserted within the ear canal of a user.

Figure 1C:
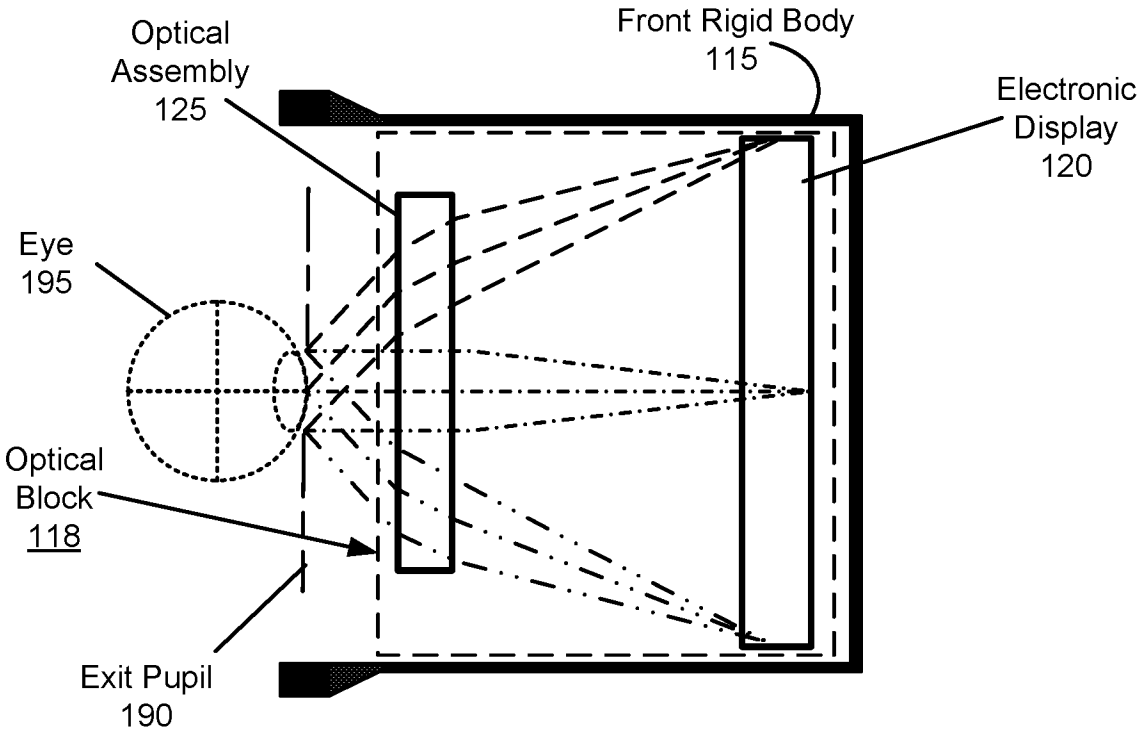
FIG. 1C is a cross section of the front rigid body of the head-mounted display shown in FIG. 1B.

FIG. 1C is a cross section of the front rigid body 115 of the head-mounted display shown in FIG. 1B. As shown in FIG. 1C, the front rigid body 115 includes an optical block 118 that provides altered image light to an exit pupil 190. The exit pupil 190 is the location of the front rigid body 115 where a user's eye 195 is positioned. For purposes of illustration, FIG. 1C shows a cross section associated with a single eye 195, but another optical block, separate from the optical block 118, provides altered image light to another eye of the user.

The optical block 118 includes a display element 120, and the optics block 125. The display element 120 emits image light toward the optics block 125. The optics block 125 magnifies the image light, and in some embodiments, also corrects for one or more additional optical errors (e.g., distortion, astigmatism, etc.). The optics block 125 directs the image light to the exit pupil 190 for presentation to the user.

System Architecture

Figure 2A:
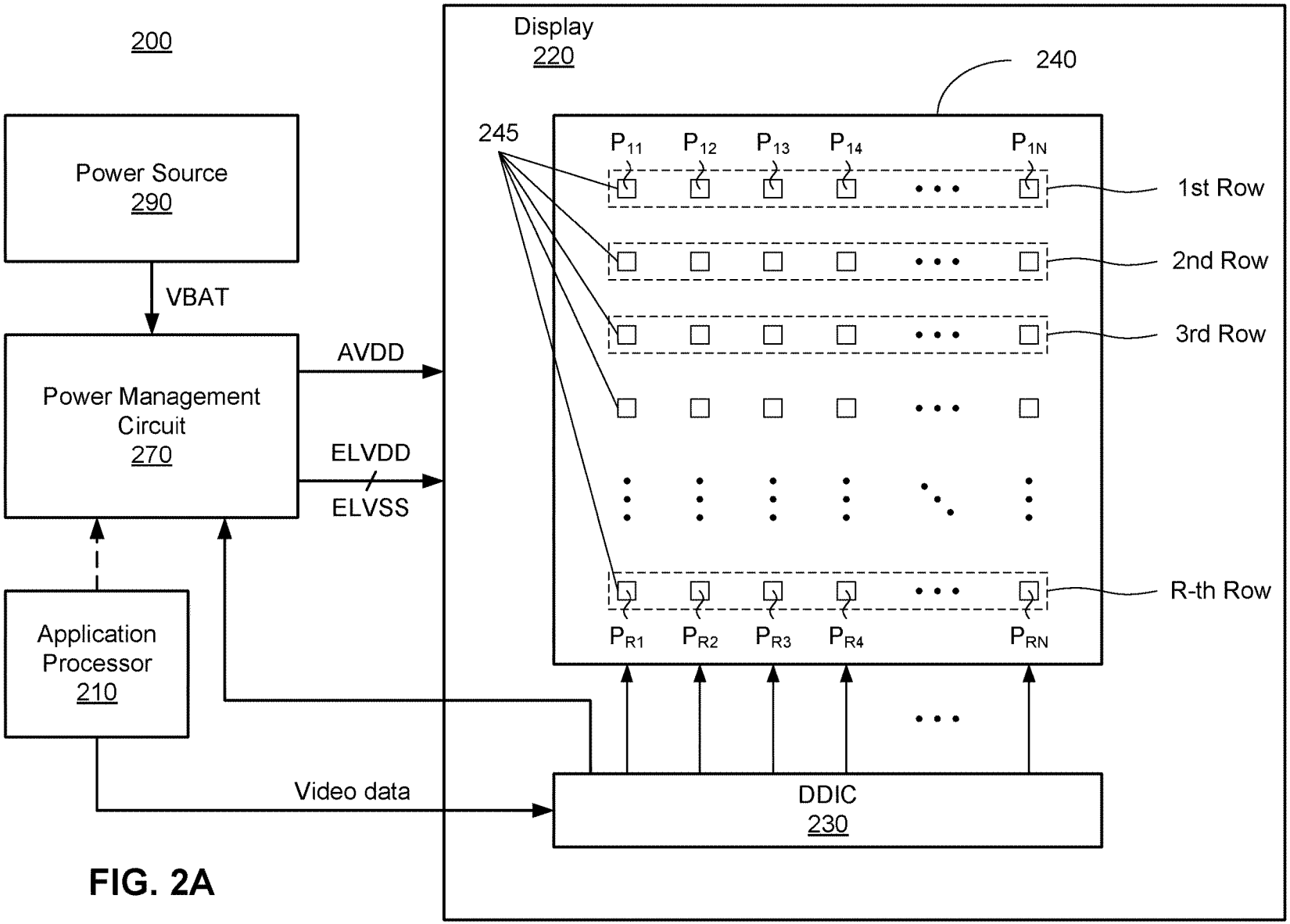
FIG. 2A illustrates a block diagram of an electronic display environment, according to one or more embodiments.

FIG. 2A illustrates a block diagram of an electronic display environment 200, according to one or more embodiments. The electronic display environment 200 includes an application processor 210 and a display device 220. In some embodiments, the electronic display environment 200 additionally includes a power management circuit 270 (such as a power management integrated circuit (PMIC)) for providing electrical power to the application processor 210 and the display device 220. In some embodiments, the power management circuit 270 receives electrical power from a power source 290 (such as a battery or an electrical outlet).

The application processor 210 generates display data for controlling the display device to display a desired image. The display data include multiple pixel data, each for controlling one pixel of the display device to emit light with a corresponding intensity. In some embodiments, each pixel data includes sub-pixel data corresponding to different colors (e.g., red, green, and blue). Moreover, in some embodiments, the application processor 210 generates display data for multiple display frames to display a video.

The display device 220 includes a display driver integrated circuit (DDIC) 230, and a display panel 240. In some embodiments, the display device 220 includes additional elements, such as one or more sensors (e.g., light sensors, proximity sensors, temperature sensors, etc.). The display device 220 may be part of the HMD 100 in FIG. 1A or FIG. 1B. That is, the display device 220 may be an embodiment of the display element 120 in FIG. 1A or FIG. 1C.

In one embodiment, the display device 220 may display a plurality of frames of video content based on a global illumination where all the pixels 245 simultaneously illuminate image light for each frame. In an alternative embodiment, the display device 220 may display video content based on a segmented illumination where all pixels 245 in each segment of the display device 220 simultaneously illuminate image light for each frame of the video content. For example, each segment of the display device 220 may include at least one row of pixels 245 in the display device 220. In the illustrative case where each segment of the display device 220 for illumination includes one row of pixels 245, the segmented illumination can be referred to as a rolling illumination. In yet another embodiment, the display device 220 may display video content based on a controllable illumination where all pixels 245 in a portion of the display device 220 of a controllable size (not shown in FIG. 2A) simultaneously illuminate image light for each frame of the video content. The controllable portion of the display device 220 can be rectangular, square or of some other suitable shape. In some embodiments, a size of the controllable portion of the display device 220 can be a dynamic function of a frame number.

The display area 240 includes a set of pixels 245 organized in rows and columns. For example, the display area 240 includes N pixels ($P_{11}$ through $P_{1N}$) in the first row, N pixels ($P_{21}$ through $P_{2N}$) in the second row, N pixels ($P_{31}$ through $P_{3N}$) in the third row, and so on. Each pixel is controlled to provide a light output that corresponds to the display signal received from the application processor 210. For instance, in the case of an OLED panel, the display area 240 includes an array of pixels, each having an OLED that is capable of emitting light with a controllable intensity.

Figure 2C:
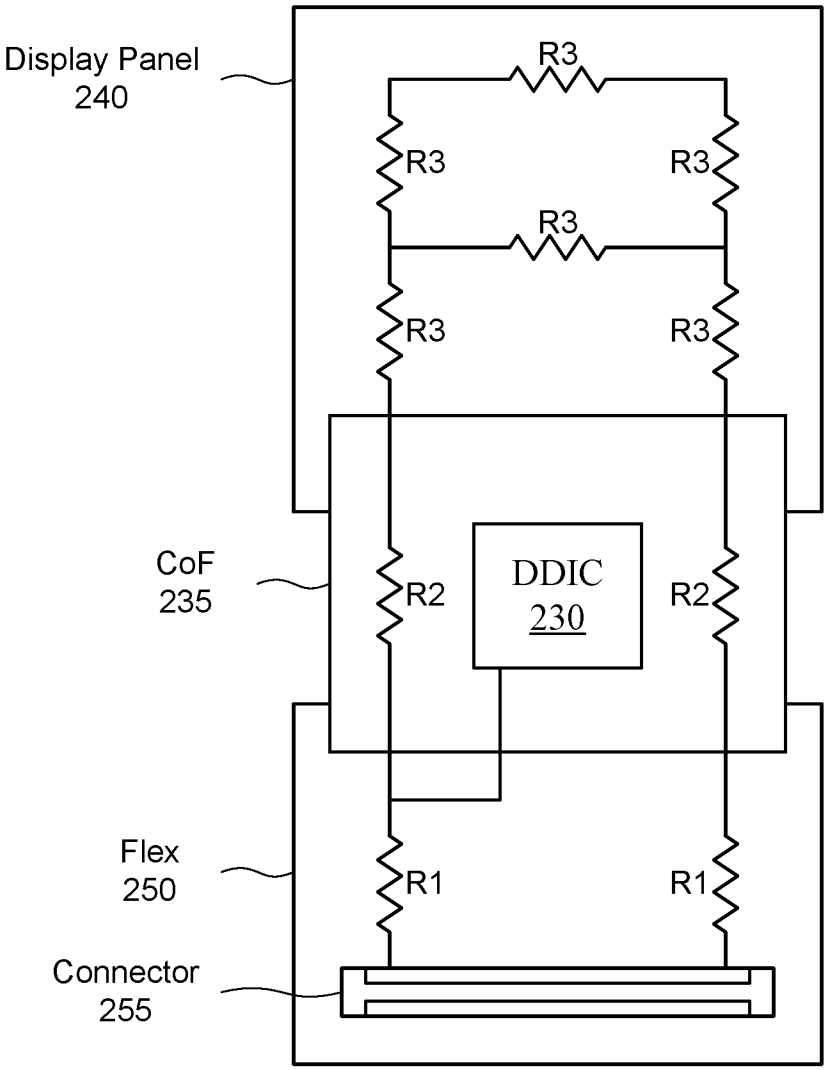
FIG. 2C illustrates a circuit diagram modeling the power distribution across a display panel, according to one or more embodiments.
Figure 2B:
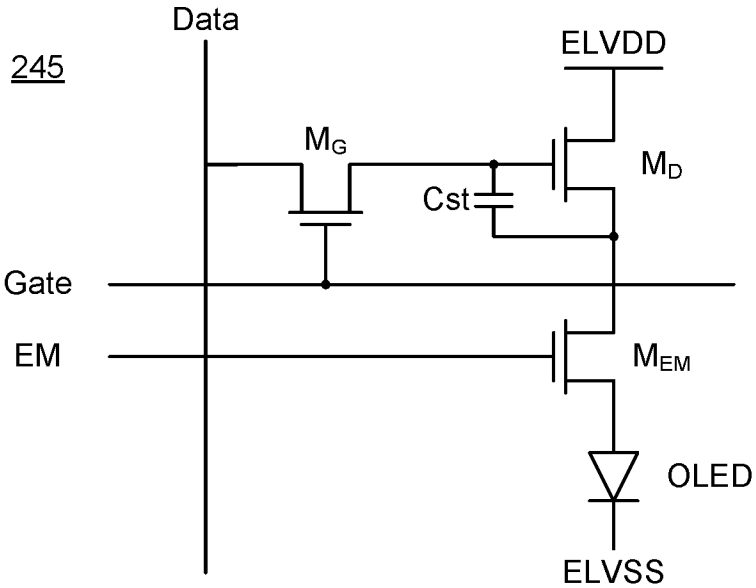
FIG. 2B illustrates an example OLED pixel structure for a pixel in the display area, according to one or more embodiments.

FIG. 2B illustrates an example OLED pixel structure for a pixel 245 in the display area 240, according to one or more embodiments. The pixel structure includes a driving transistor MD that is configured to generate a current proportional to a voltage stored by the storage capacitor Cst for driving the OLED. The OLED then generates light that is proportional to an amount of current provided by the driving transistor MD. Since the brightness of the pixel is proportional to the current being provided to the OLED, the amount of power consumed by the OLED is also proportional to the desired brightness of the OLED. That is, a display device 220 implemented using OLEDs consumes more power when displaying a brighter image compared to displaying a relatively darker image.

The gate transistor MG controls a connection between the gate of the driving transistor MD and the data line. When the gate line is asserted, the gate transistor MG turns on connecting the gate of the driving transistor MD to the data line and charging the storage capacitor Cst based on a voltage value provided at the data line. When the gate line is not asserted, the gate transistor MG is turned off, disconnecting the gate of the driving transistor MG from the data line. The emission transistor MEM controls a connection between the driving transistor MD and the OLED. When the emission signal EM is asserted, the emission transistor MEM turns on, connecting the driving transistor MD to the OLED. When the driving transistor MD is connected to the OLED, the driving transistor MD is turned on. In some embodiments, the data line is shared by a set of pixels disposed in a same column of the display area 240. Moreover, the gate line is shared by a set of pixels disposed in the same row of the display area.

Referring back to FIG. 2A, the DDIC 230 receives a display signal from the application processor 210, and generates control signals for controlling each pixel 245 in the display area 240. For example, the DDIC 230 generates signals to program each of the pixels 245 in the display area 240 according to an image signal received from the application processor 210. Moreover, the DDIC 230 generates a signal to turn on a driving transistor of one or more pixels 245 at predetermined periods of time.

FIG. 2C illustrates a circuit diagram modeling a power delivery network in a display device 220, according to one or more embodiments. In some embodiments, the display panel 240 is connected to a chip-on-film (CoF) having the DDIC 230. Moreover, the CoF is connected to a flex cable 250 for allowing external components such as the application processor 210 and/or the power management circuit 270 to interface with the display 220. Power may be received (e.g., from the power management circuit 270) through a connector 255 of the flex cable 250. The power may then run through power rails and distributed across the display panel 240. For example, the display device 220 may receive multiple power supply voltages (e.g., ELVDD, ELVSS, AVDD) and may provide each power supply voltage to each of the pixels 245. The conductors use to distribute each of the power supply voltages have a resistance (e.g., based on the resistivity of the conductor, the length of the conductor, and the cross sectional area of the conductor). For example, the conductors used in the flex 250 for routing the power supply voltages to the CoF may have a first resistivity R1. Similarly, the conductors used in the CoF 235 for routing the power supply voltages received from the flex 250 to the display panel 240 may have a second resistivity R2. Moreover, the conductors used in the display panel 240 for routing the power supply voltages received from the CoF to each of the pixels may have a third resistivity R3. When current flows through the conductors of one or more of the power rails, a voltage drop is generated across the conductors, reducing the voltage that reaches a pixel (compared to the nominal value of the power supply voltage). Variations in power supply voltage levels reaching each of the pixels may cause optical artifacts when the pixel is activated to emit light. For example, depending on the topology used for routing the power supply voltages, pixels in one region of the display panel (e.g., pixels near the top of the display panel) may experience a higher resistance than pixels in another region of the display panel (e.g., pixels near the bottom of the display panel). As such, pixels experiencing higher resistance may receive lower power supply voltages than pixels experiencing lower resistance due to an increased voltage drop across the conductors used for distributing the power supply voltages.

Frame Structure and Timing

Figure 3:
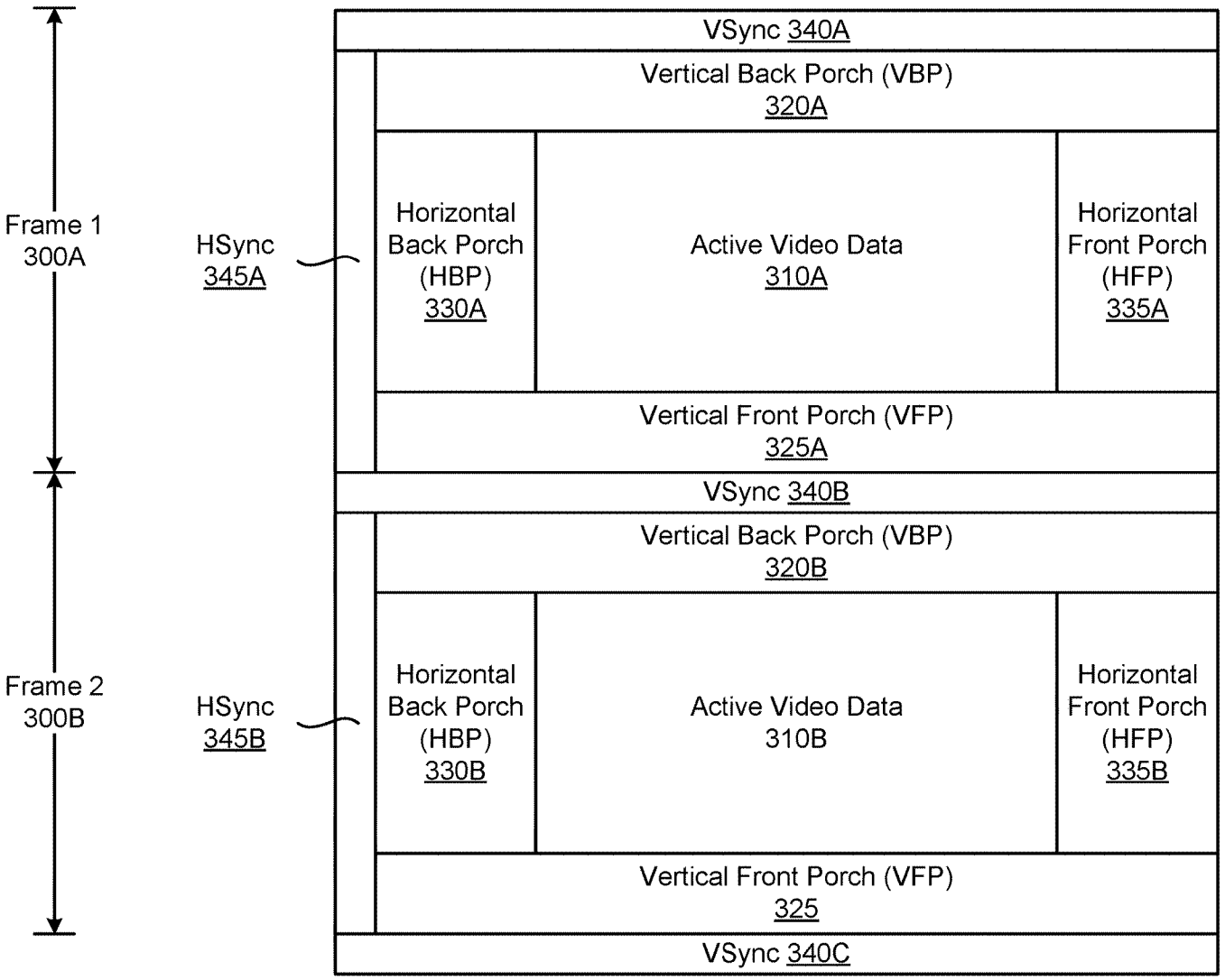
FIG. 3 illustrates the structure of video frames transmitting video data for displaying a video by a display device, according to one or more embodiments.

FIG. 3 illustrates the structure of video frames transmitting video data for displaying a video by a display device 220, according to one or more embodiments. In particular, FIG. 3 shows two frames 300. Each frame 300 includes a vertical synchronization (VSync) 340 signal, a vertical back port (VBP) 320, a vertical front porch (VFP) 325, a horizontal back porch (HBP) 330, a horizontal front port (HFP) 335, active video data 310, and horizontal synchronization (HSync) signals 345A. The frames 300 are separated by vertical synchronization (VSync) 340 signals.

The active video area 310 contains the video data to be displayed during the current frame. The video data includes pixel data for each pixel of the display device 220. The video data is divided into multiple rows. For example, for a 1080p video, the active video data 310 includes 1080 rows, and each row includes 1920 pixels. Similarly, for a 4K video, the active video data 310 is divided into 2160 rows, each having 3840 pixels across.

The VSync signal 340 signals the display device 220 the start of a new frame 300. The VSync signal 340 has a pre-determined pattern or format (e.g., a predetermined duration). The VSync signal 340 enables the display device 220 to receive video data at irregular frame rates. That is, the VSync signal 340 allows the display device 220 to synchronize the display frame rate to the frame rate of the video data being received.

The VBP 320 is a portion of a frame 300 that comes after the VSync signal 340 and before active video data 310. The VBP 320 may be used to provide metadata to the display device 220. Additionally, the VFP 325 is a portion of a frame 300 that comes after the active video data 310. In some embodiments, the VFP 325, VSync 320 and the VBP 320 are referred to as the vertical blanking interval (VBlank or VBI).

The HSync signal 345 signals the display device 320 the start of a new row within the current frame 300. As such, the HSync signal 345 is provided to the display device 220 multiple times (at least once per row) within a single frame 300. The HSync signal 345 has a pre-determined pattern or format. The HBP 330 is a portion of the frame 300 after the HSync signal 345 and before active video data 310. The HFP 335 is a portion of the frame 300 after active video data 310 and before the HSync signal 345. In some embodiments, the HFP 335, HSync 325, and the HBP 330 are referred to as the horizontal blanking interval (HBlank or HBI).

Display Sequence

Figure 4A:
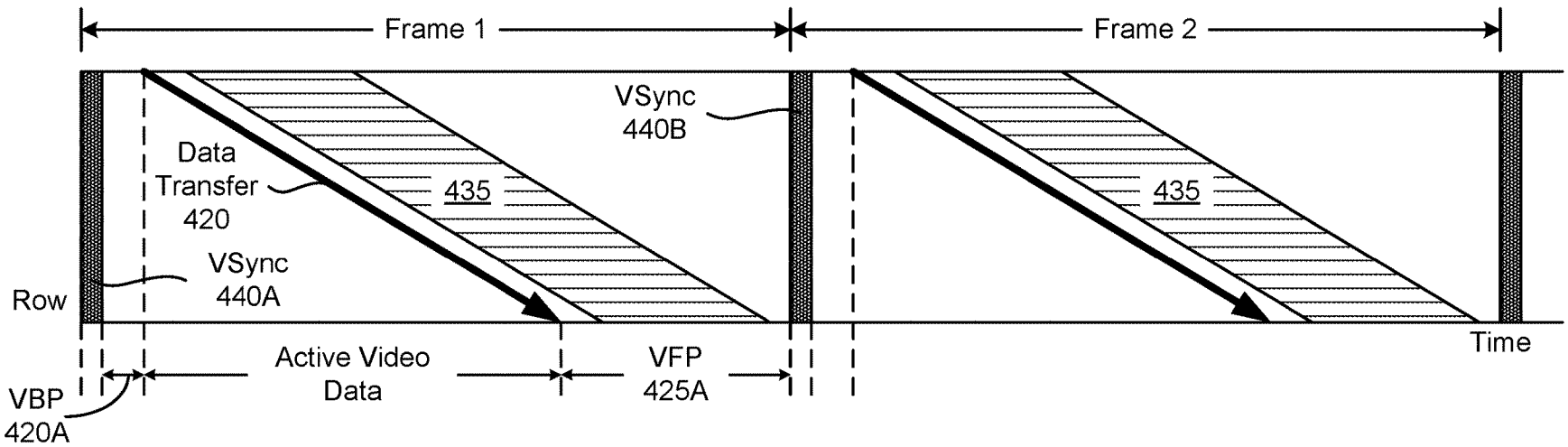
FIG. 4A illustrates a time diagram of the operation of a display device in a rolling illumination mode, according to one or more embodiments.

FIG. 4A illustrates a time diagram of the operation of a display device 220 in a rolling illumination mode, according to one or more embodiments. The first frame 400A starts when the display device 220 receives the VSync signal 440A. After receiving the VSync signal 440A, the display device 220 starts receiving the data included in the VBP 420A. After the VBP 420A has been received, the display device 220 starts receiving the active video data 310A (e.g., during a data transfer period 420). Based on the active video data 410A, the display device programs each pixel. In some embodiments, the display device programs each pixel as corresponding video data is received. Alternatively, the display device programs each pixel during a separate data scanning period. In some embodiments, the data scanning period is performed during the VFP period 425. In other embodiments, the data scanning period may start while the active video data 410 is being received and may overlap with the data transfer period 420.

In the rolling illumination mode, after a set of pixels (e.g., pixels in a given row of pixels) have been programed, the pixels are activated to cause the pixels to emit light. Specifically, in the rolling illumination mode, the illumination period (when at least a subset of pixels is being illuminated), starts before the data transfer period (and/or the data scanning period) ends and overlaps with the data transfer period (and/or the data scanning period).

In some embodiments, a first subset of pixels (e.g., a first row of pixels) of the display device is illuminated during a first portion of the illumination period for a predetermined amount of time. After the first subset of pixels are illuminated, a second subset of pixels (e.g., a second row of pixels) of the display device is illuminated during a second portion of the illumination period. This process continues until every subset of pixels (e.g., every row of pixels) have been illuminated.

The first frame 400A ends and the second frame 400B starts when the VSync signal 440B is received by the display device 220. In some embodiments, the duration of a frame is the time from which the VSync signal 440 indicating the start of the frame is received until when the VSync signal 440 indicating the start of the next frame is received.

Figure 4B:
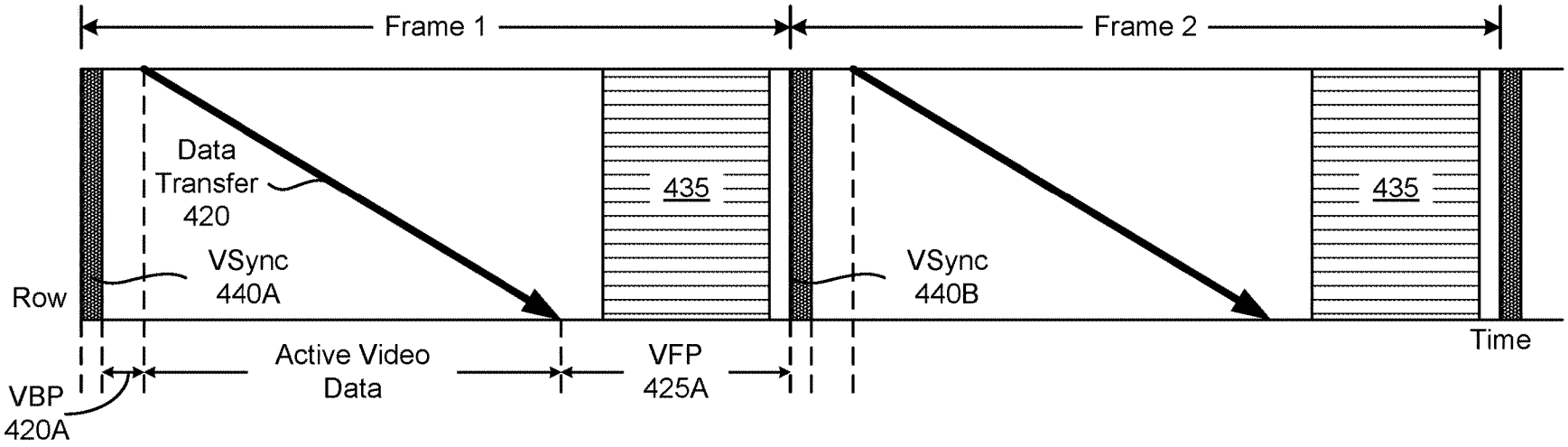
FIG. 4B illustrates a time diagram of the operation of a display device in a global illumination mode, according to one or more embodiments.

FIG. 4B illustrates a time diagram of the operation of a display device 220 in a global illumination mode, according to one or more embodiments. The first frame 400A starts when the display device 220 receives the VSync signal 440A. After receiving the VSync signal 440A, the display device 220 starts receiving the data included in the VBP 420A. After the VBP 420A has been received, the display device 220 starts receiving the active video data 410A (e.g., during a data transfer period 420). Based on the active video data 410A, the display device programs each pixel. In some embodiments, the display device programs each pixel as corresponding video data is received. Alternatively, the display device programs each pixel during a separate data scanning period. In some embodiments, the data scanning period is performed during the VFP period 425. In other embodiments, the data scanning period may start while the active video data 410 is being received and may overlap with the data transfer period 420.

Unlike the rolling illumination mode, in the global illumination model, all the pixels of the display device 220 are illuminated at the same time (or substantially the same time) during an illumination period. Moreover, in the global illumination mode, the illumination period 435 does not overlap with the data transfer period 420 (and/or the data scanning period), and follows the data transfer period 420.

The global illumination mode may provide a better visual experience in certain applications (such as in virtual reality headsets). However, since every pixel is illuminated at the same time, the amount of current drawn by the display device to activate the pixels is higher than in the rolling illumination mode. As a result, optical artifacts appear in the display panel due to higher voltage drops across the conductors used for distributing the power across the display panel.

Adaptive Power Supply Circuit

Figure 5:
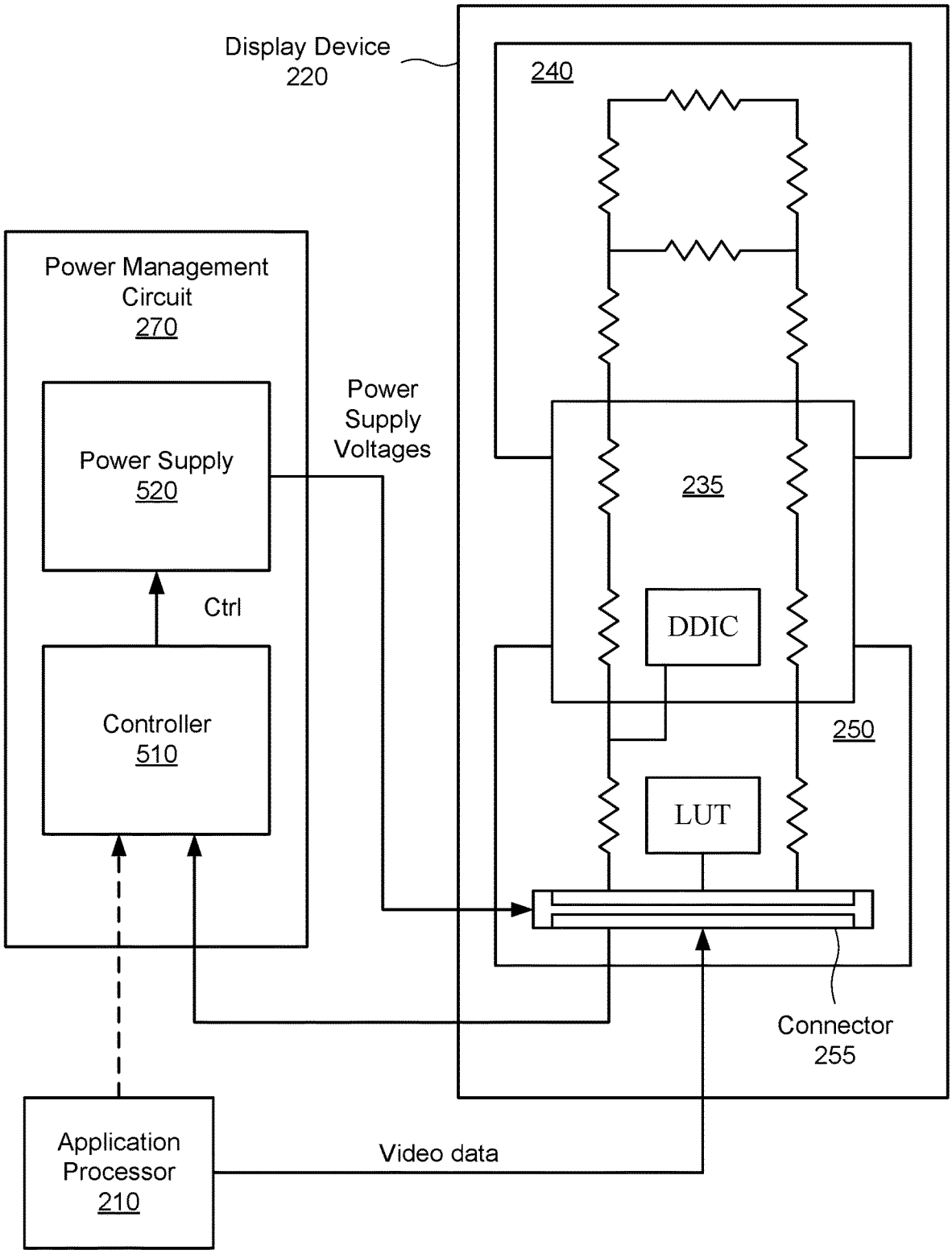
FIG. 5 illustrates a block diagram of the power management circuit, according to one or more embodiments.

FIG. 5 illustrates a block diagram of the power management circuit 270, according to one or more embodiments. The power management circuit 270 includes, among other components, a controller circuit 510 and a power supply circuit 520. In some embodiments, the power management circuit is connected to the display device 220 (e.g., via the connector 255). The power management circuit 270 is configured to provide one or more power supply voltages (e.g., ELVDD, ELVSS, AVDD, etc.) to the display device 220. Moreover, in some embodiments, the power management circuit 270 is configured to receive one or more data or control signals from the display device 220. Alternatively, or in addition, the power management circuit 270 is configured to receive one or more data or control signals from the application processor 210.

The controller circuit 510 receives one or more data signals (e.g., as video data, a brightness level, a frame rate, a panel temperature, or an on-pixel-ratio (OPR)) value from the display device 220 (or optionally from the application processor 210) and a power supply control signal Ctrl for controlling the power supply circuit 520. In some embodiments, the power supply control signal Ctrl is a pulse-width-modulation (PWM) control signal, a pulse-frequency-modulation (PFM) control signal, a digital control signal, an analog control signal, or the like.

As used herein, the OPR is the ratio between the grayscale level of each of the pixels in an image to be displayed by the display panel, and the maximum grayscale level for the pixels. In some embodiments, the OPR may be determined based the digital values of each of the pixels of the image to be displayed. For example, the OPR may be determined as:

$$OPR = \frac{\sum_{all\ sub\text{-}pixels} \text{grayscale_level}}{\sum_{all\ sub\text{-}pixels} \text{max_grayscale_level}} \quad (1)$$

For example, if the display device is rectangular, the OPR may be determined as:

$$OPR = \frac{100}{\text{max_grayscal_level} \times R \times N} \sum_{j=1}^{R} \sum_{i=1}^{N} \text{grayscale_level}_{ij} \quad (2)$$

where N is the number of pixels in a columns, R is the number of rows, $\text{gray_scale_level}_{ij}$ is the gray scale value of the pixel (or sub-pixel) located at the i-th column and the j-th row, and max_gray_scal_level is the maximum grayscale value for a pixel (e.g., 255).

In other embodiments, the OPR value is determined using a predefined function $f(x)$ as follows:

$$OPR = \frac{100}{f(\text{max_grayscal_level}) \times R \times N} \sum_{j=1}^{R} \sum_{i=1}^{N} f(\text{grayscale_level}_{ij}) \quad (3)$$

For instance, the predefined function $f(x)$ may be the gamma function:

$$f(x)=A \cdot x^{\gamma} \quad (4)$$

where A and $\gamma$ are a constant value (e.g., 1 and 2.2 respectively).

Since the OPR is based on the image to be displayed and not based on properties of the power supply circuit or the display device, the OPR may be determined by the application processor 210 to reduce an amount of data to be transferred to the power management circuit 270. That is, the application processor 210 may include custom circuitry or may run a custom firmware to enable the calculation of the OPR. Alternatively, to enable the power management circuit 270 to be used with unmodified application processors, the power management circuit 270 may receive display data from the application processor 210 or the DDIC 230 and the controller circuit 510 of the power management circuit 270 determines the OPR for the image to be displayed internally. For example, the same video data being provided to the DDIC 230 may be provided to the power management circuit 270 to enable the controller circuit 510 of the power management circuit 270 to calculate the OPR. In yet other embodiments, the power supply circuit receives the OPR from the display device 220. For example, the DDIC 230 of the display device 220 determines the OPR from the video data the DDIC receives from the application processor 210, and the DDIC 230 provides the OPR to the power management circuit 270.

In addition, or alternatively, the controller circuit 510 receives one or more configurations parameters from the display device 220. For example, based on the received one or more data signals, the control circuit 510 identifies an entry in the lookup table (LUT) of the display device 220. The controls circuit 510 then sends a request to the display device for the information stored in the identified entry and receives the configuration parameters stored in the identified entry of the LUT. In another example, the configuration parameters are determined based on one or more equations or formulas stored in a non-volatile memory of the display device 220. In this example, the control circuit 520 may send a request to the display device to calculate the configuration parameters based on the received one or more data signals. In some embodiments, the configuration parameters specify a waveform for one or more power supply voltages. For each power supply voltage, the configuration parameters specify a voltage level (or a deviation from a nominal value) at one or more specified time points. For example, the configuration parameters may specify that the ELVDD should be boosted by 1.5% after 3.4 microseconds from the start of a video frame, by 1% after 3.5 microseconds from the start of the video frame, by 0.5% after 3.6 microseconds from the start of the video frame, and should be kept at nominal value after 3.7 microseconds from the start of the video frame.

Moreover, the controller circuit 510 may receive one or more control signals (such as the VSync signal), and generates the power supply control signal based on the received one or more control signals. For example, the control circuit 510 generates the power supply control signal Ctrl to be synchronized to the VSync signal received from the display device 220 or the application processor 210.

The power supply circuit 520 includes circuitry for converting the power received from the power source 290 into a set of power supply voltages to be provided to the display device 220. The power supply circuit 520 may include a set of voltage regulators that can be configured to generate a regulated output voltage having a voltage level set by the power supply control signal Ctrl received from the control circuit 510. In some embodiments, the power supply circuit 520 may include a first voltage regulator for generating a panel voltage (AVDD), a second voltage regulator for generating a positive panel emission voltage (ELVDD), and a third voltage regulator for generating a negative panel emission voltage (ELVSS). Each voltage regulator may be configured to have a nominal voltage level, and may include an input for controlling the voltage regulator to increase or decrease the output voltage based on a value of the signal provided through the input. For instance, the first voltage regulator may have a nominal output voltage of 6.0V, the second voltage regulator may have a nominal output voltage of 5.0V, and the third voltage regulator may have a nominal output voltage of −2.0V.

Figure 6:
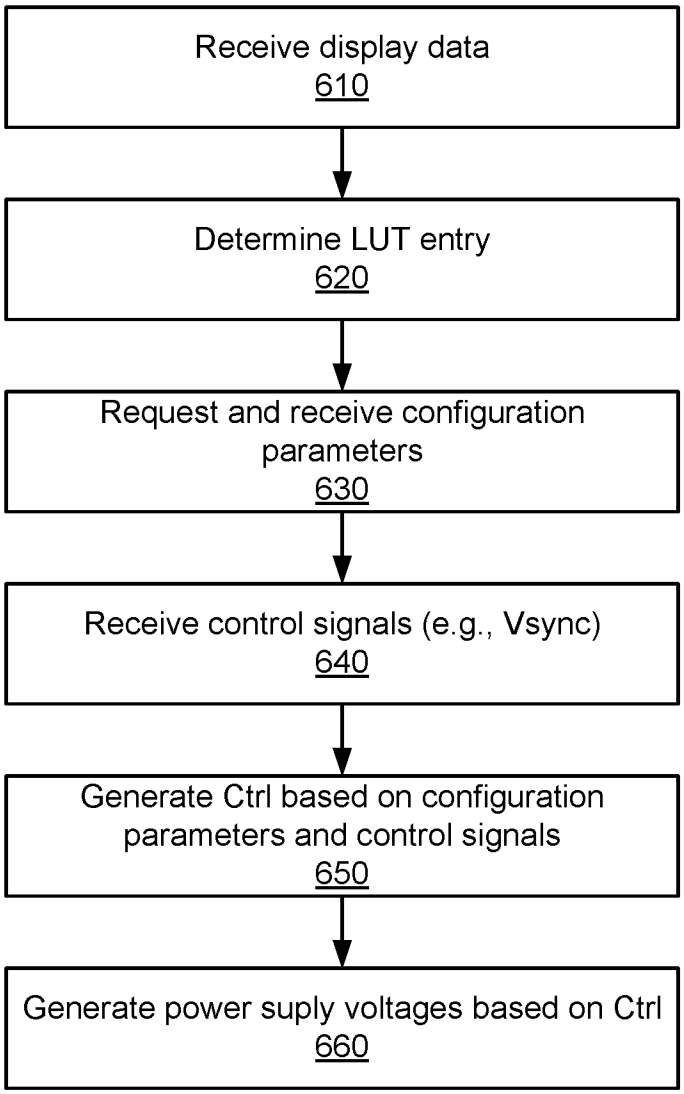
FIG. 6 illustrates a flow diagram of a process for generating power supply voltages for operating a display device, according to one or more embodiments.

FIG. 6 illustrates a flow diagram of a process for generating power supply voltages for operating a display device 220, according to one or more embodiments. The process shown in FIG. 6 may be performed by the power management circuit 270, the display device 220, or the application processor 210. Other entities may perform some or all of the steps in FIG. 6 in other embodiments. Embodiments may include different and/or additional steps, or perform the steps in different orders.

The controller circuit 510 of the power management circuit 270 receives 610 display data. In some embodiments, the display data is received from the display panel 220 (e.g., from the DDIC of the display panel through the connector 255 of the flex 250). In other embodiments, the display data is received from the application processor 210. In some embodiments, the display data is at least one of video data for a video frame to be displayed by the display device 220, a brightness level for an image to be displayed by the display device 220, a frame rate of the display device 220, a panel temperature of the display panel 240 of the display device 220, or an on-pixel-ratio (OPR) for the image to be displayed by the display device 220.

Based on the display data, the controller circuit 510 determines 620 a LUT entry. In other embodiments, the LUT entry is determined by the application processor 210 or the DDIC of the display device 220. In those embodiments, the display data may not be provided to the power management circuit 270.

The controller circuit 510 sends a request to the display device for configuration parameters associated with the identified LUT entry, and receives 630 the configuration parameters from the display device 220. The controller circuit 510 additionally receives control signals (such as the VSync signal, a frame rate, etc.) from the display device 220 or from the application processor 210. Based on the control signals and the configuration parameters, the controller circuit 510 generates the Ctrl signal for controlling the power supply circuit 520. In some embodiments, the Ctrl signal is synchronized to the VSync signal received by the controller circuit 510. Moreover, in some embodiments, the timing of the Ctrl signal is further based on the frame rate of the display device 220.

The power supply circuit 520 receives the Ctrl signal and configures one or more voltage regulators to generate an output corresponding to a value of the Ctrl signal. In some embodiments, the Ctrl signal specifies a deviation from a nominal output. The Ctrl signal may be a digital signal or an analog signal. In some embodiments, if the Ctrl signal is a digital signal, the Ctrl signal is converted into an analog signal for controlling the voltage regulators of the power supply circuit 520.

Display Panel Calibration

In some embodiments, the LUT of the display device 220 is generated using a calibration process. The calibration process may provide a set of images to the display device to be displayed by the display panel 240, and may capture an output of the display device 220. The captured output is the analyzed and entries for the LUT are generated and stored. In some embodiments, each display device is individually calibrated, and display device dependent entries are generated and stored in the LUT. Alternatively, the calibration process may be performed in batches (e.g., with every display device in a batch sharing the same LUT entries).

In some embodiments, the calibration process is performed using a camera capturing optical defects of test images displayed by the display panel 240 of a display device 220. Alternatively, in other embodiments, the calibration process is performed using a scope (e.g., an oscilloscope) capturing voltage and/or current waveforms produced as a response to displaying the test images by the display panel 240 of the display device 220.

Figure 7:
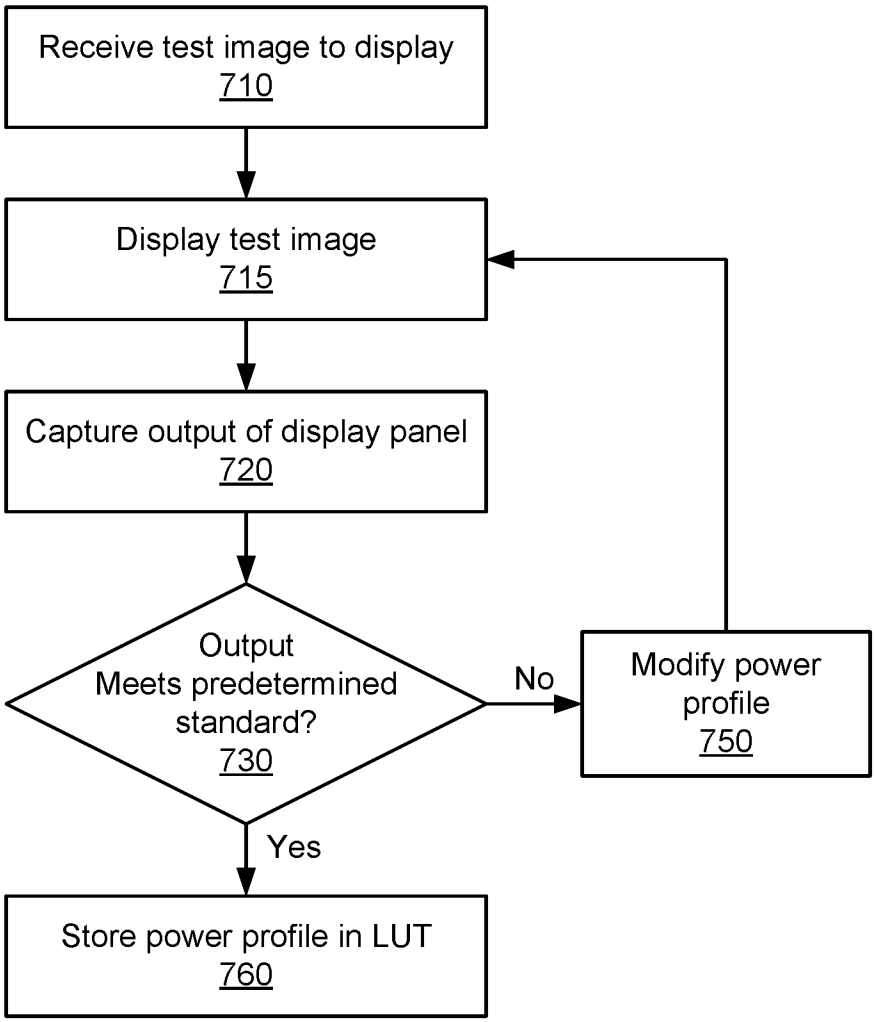
FIG. 7 illustrates a flow diagram of a process for calibrating a display device 220, according to one or more embodiments.

FIG. 7 illustrates a flow diagram of a process for calibrating a display device 220, according to one or more embodiments. The process shown in FIG. 7 may be performed by the display panel 220 or a calibration system interfacing with a display panel. Other entities may perform some or all of the steps in FIG. 7 in other embodiments. Embodiments may include different and/or additional steps, or perform the steps in different orders.

The display panel 220 receives 710 a test image and displays 715 the test image. In some embodiments, at the beginning of the calibration process, the display panel is provided with power supply voltages at their respective nominal values. Using one or more sensors, an output of the display panel is captured 720. For instance, the one or more sensors may include a camera capturing an image of the display panel displaying the test image. In another example, the one or more sensors include an oscilloscope capturing voltages or currents at various locations within the display panel.

The captured output of the display panel is compared 730 to a predetermined standard. If the captured output meets the predetermined standard, the power supply configuration parameters used for generating the power supply voltages for operating the display device are stored in the LUT of the display device. Alternatively, if the captured output of the display device does not meet the predetermined standard, the power profile is modified (e.g., by modifying the configuration parameters provided to the power management circuit 270) and the process loops back to step 715. This is repeated until the captured output of the display device meets the predetermined standard.

In some embodiments, when the captured output of the display device is an image of the display panel, the calibration system determines whether the captured image shows visible artifacts in the display panel in response to displaying the test image. If the captured image shows that there are no visible artifacts (or that the visible artifacts are below a predetermined standard), the calibration system determines that the output of the display device meets the predetermined standard. Alternatively, if the captured image shows visible artifacts in the display panel, the calibration system determines that the output of the display device does not meet the predetermined standard.

In another embodiments, when the captured output of the display device is a set of voltage or current waveforms, the calibration system determines whether each of the voltage or current waveforms follow a predetermined range or shape. In some embodiments, a value (such as an average or a spread) is determined based on the voltage or current waveforms, and the value is compared to a predetermined standard.

In some embodiments, the steps of FIG. 7 are repeated for a set of test images. For example, for each test image, a new LUT entry is generated and stored in the LUT of the display device. That is, for each test image, an LUT index is calculated based on display data associated with the test image, and the power profile or power configuration parameters determined using the steps of FIG. 7 is stored in association with the determined LUT index.

Example Power Supply Voltage Waveform

Figure 8:
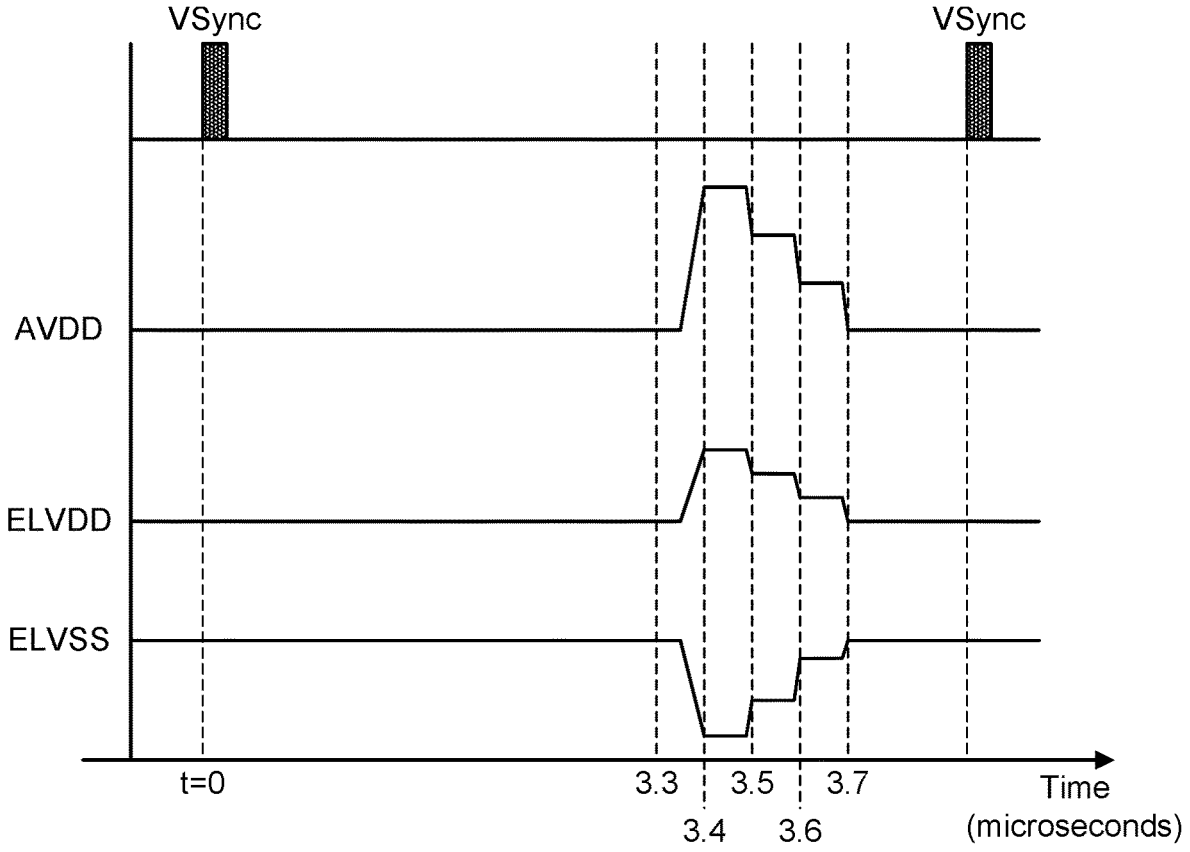
FIG. 8 illustrates an example LUT entry 810, and example power supply voltage waveforms generated based on the configuration parameters stored in the LUT entry, according to one or more embodiments.

FIG. 8 illustrates an example LUT entry 810, and example power supply voltage waveforms generated based on the configuration parameters stored in the LUT entry, according to one or more embodiments. In some embodiments, the configuration parameters stored in a LUT entry includes a voltage profile for each of the power supply voltages to be provided to the display device during a given display frame. The LUT may store voltage values for a set of times (synchronized to the start of the display frame or the VSync signal).

As shown in the LUT entry 810 of FIG. 8, the configuration parameters instruct the power management circuit 270 to generate an AVDD with a waveform having a nominal value between time t=0 and 3.4 microseconds, a value 3.0% above nominal from time t=3.4 microseconds to 3.4 microseconds, a value 2.0% above nominal from time t=3.5 microseconds to 3.6 microseconds, a value 1.0% above nominal from time t=3.6 microseconds to 3.7 microseconds, and the nominal value from time t=3.7 microseconds until the end of the display frame. Similarly, the configuration parameters instruct the power management circuit 270 to generate an ELVDD with a waveform having a nominal value between time t=0 and 3.4 microseconds, a value 1.5% above nominal from time t=3.4 microseconds to 3.4 microseconds, a value 1.0% above nominal from time t=3.5 microseconds to 3.6 microseconds, a value 0.5% above nominal from time t=3.6 microseconds to 3.7 microseconds, and the nominal value from time t=3.7 microseconds until the end of the display frame. Moreover, the configuration parameters instruct the power management circuit 270 to generate an ELVSS with a waveform having a nominal value between time t=0 and 3.4 microseconds, a value 2.0% above nominal from time t=3.4 microseconds to 3.4 microseconds, a value 1.3% above nominal from time t=3.5 microseconds to 3.6 microseconds, a value 0.4% above nominal from time t=3.6 microseconds to 3.7 microseconds, and the nominal value from time t=3.7 microseconds until the end of the display frame. Based on the configuration parameters, the controller circuit 510 of the power management circuit 270 configures the power supply circuit 520 (e.g., the voltage regulators of the power supply circuit) to output power supply voltages that follow the waveform specified by the configuration parameters.

System Environment

Figure 9:
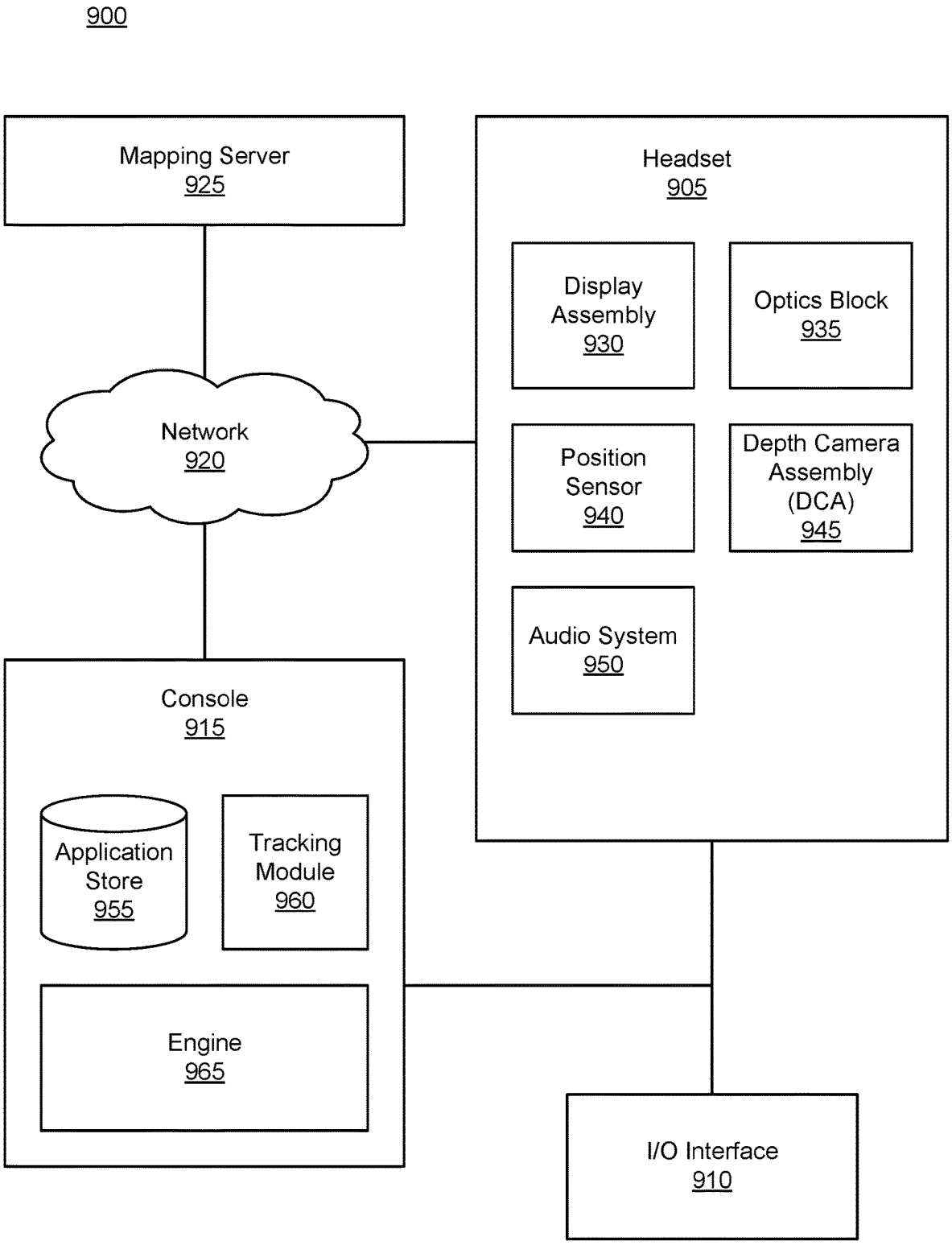
FIG. 9 is a system that includes a headset, according to one or more embodiments.

FIG. 9 is a system 900 that includes a headset 905, according to one or more embodiments. In some embodiments, the headset 905 may be the headset 100 of FIG. 1A or the headset 105 of FIG. 1B. The system 900 may operate in an artificial reality environment (e.g., a virtual reality environment, an augmented reality environment, a mixed reality environment, or some combination thereof). The system 900 shown by FIG. 9 includes the headset 905, an input/output (I/O) interface 910 that is coupled to a console 915, the network 920, and the mapping server 925. While FIG. 9 shows an example system 900 including one headset 905 and one I/O interface 910, in other embodiments any number of these components may be included in the system 900. For example, there may be multiple headsets each having an associated I/O interface 910, with each headset and I/O interface 910 communicating with the console 915. In alternative configurations, different and/or additional components may be included in the system 900. Additionally, functionality described in conjunction with one or more of the components shown in FIG. 9 may be distributed among the components in a different manner than described in conjunction with FIG. 9 in some embodiments. For example, some or all of the functionality of the console 915 may be provided by the headset 905.

The headset 905 includes the display assembly 930, an optics block 935, one or more position sensors 940, and the DCA 945. Some embodiments of headset 905 have different components than those described in conjunction with FIG. 9. Additionally, the functionality provided by various components described in conjunction with FIG. 9 may be differently distributed among the components of the headset 905 in other embodiments, or be captured in separate assemblies remote from the headset 905.

The display assembly 930 displays content to the user in accordance with data received from the console 915. The display assembly 930 displays the content using one or more display elements (e.g., the display elements 120). A display element may be, e.g., an electronic display. In various embodiments, the display assembly 930 comprises a single display element or multiple display elements (e.g., a display for each eye of a user). Examples of an electronic display include: a liquid crystal display (LCD), an organic light emitting diode (OLED) display, an active-matrix organic light-emitting diode display (AMOLED), a waveguide display, some other display, or some combination thereof. Note in some embodiments, the display element 120 may also include some or all of the functionality of the optics block 935.

The optics block 935 may magnify image light received from the electronic display, corrects optical errors associated with the image light, and presents the corrected image light to one or both eyeboxes of the headset 905. In various embodiments, the optics block 935 includes one or more optical elements. Example optical elements included in the optics block 935 include: an aperture, a Fresnel lens, a convex lens, a concave lens, a filter, a reflecting surface, or any other suitable optical element that affects image light. Moreover, the optics block 935 may include combinations of different optical elements. In some embodiments, one or more of the optical elements in the optics block 935 may have one or more coatings, such as partially reflective or anti-reflective coatings.

Magnification and focusing of the image light by the optics block 935 allows the electronic display to be physically smaller, weigh less, and consume less power than larger displays. Additionally, magnification may increase the field of view of the content presented by the electronic display. For example, the field of view of the displayed content is such that the displayed content is presented using almost all (e.g., approximately 110 degrees diagonal), and in some cases, all of the user's field of view. Additionally, in some embodiments, the amount of magnification may be adjusted by adding or removing optical elements.

In some embodiments, the optics block 935 may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display for display is pre-distorted, and the optics block 935 corrects the distortion when it receives image light from the electronic display generated based on the content.

The position sensor 940 is an electronic device that generates data indicating a position of the headset 905. The position sensor 940 generates one or more measurement signals in response to motion of the headset 905. The position sensor 185 is an embodiment of the position sensor 940. Examples of a position sensor 940 include: one or more IMUS, one or more accelerometers, one or more gyroscopes, one or more magnetometers, another suitable type of sensor that detects motion, or some combination thereof. The position sensor 940 may include multiple accelerometers to measure translational motion (forward/back, up/down, left/right) and multiple gyroscopes to measure rotational motion (e.g., pitch, yaw, roll). In some embodiments, an IMU rapidly samples the measurement signals and calculates the estimated position of the headset 905 from the sampled data. For example, the IMU integrates the measurement signals received from the accelerometers over time to estimate a velocity vector and integrates the velocity vector over time to determine an estimated position of a reference point on the headset 905. The reference point is a point that may be used to describe the position of the headset 905. While the reference point may generally be defined as a point in space, however, in practice the reference point is defined as a point within the headset 905.

The DCA 945 generates depth information for a portion of the local area. The DCA includes one or more imaging devices and a DCA controller. The DCA 945 may also include an illuminator. Operation and structure of the DCA 945 is described above with regard to FIG. 1A.

The audio system 950 provides audio content to a user of the headset 905. The audio system 950 is substantially the same as the audio system 200 describe above. The audio system 950 may comprise one or acoustic sensors, one or more transducers, and an audio controller. The audio system 950 may provide spatialized audio content to the user. In some embodiments, the audio system 950 may request acoustic parameters from the mapping server 925 over the network 920. The acoustic parameters describe one or more acoustic properties (e.g., room impulse response, a reverberation time, a reverberation level, etc.) of the local area. The audio system 950 may provide information describing at least a portion of the local area from e.g., the DCA 945 and/or location information for the headset 905 from the position sensor 940. The audio system 950 may generate one or more sound filters using one or more of the acoustic parameters received from the mapping server 925, and use the sound filters to provide audio content to the user.

The I/O interface 910 is a device that allows a user to send action requests and receive responses from the console 915. An action request is a request to perform a particular action. For example, an action request may be an instruction to start or end capture of image or video data, or an instruction to perform a particular action within an application. The I/O interface 910 may include one or more input devices. Example input devices include: a keyboard, a mouse, a game controller, or any other suitable device for receiving action requests and communicating the action requests to the console 915. An action request received by the I/O interface 910 is communicated to the console 915, which performs an action corresponding to the action request. In some embodiments, the I/O interface 910 includes an IMU that captures calibration data indicating an estimated position of the I/O interface 910 relative to an initial position of the I/O interface 910. In some embodiments, the I/O interface 910 may provide haptic feedback to the user in accordance with instructions received from the console 915. For example, haptic feedback is provided when an action request is received, or the console 915 communicates instructions to the I/O interface 910 causing the I/O interface 910 to generate haptic feedback when the console 915 performs an action.

The console 915 provides content to the headset 905 for processing in accordance with information received from one or more of: the DCA 945, the headset 905, and the I/O interface 910. In the example shown in FIG. 9, the console 915 includes an application store 955, a tracking module 960, and an engine 965. Some embodiments of the console 915 have different modules or components than those described in conjunction with FIG. 9. Similarly, the functions further described below may be distributed among components of the console 915 in a different manner than described in conjunction with FIG. 9. In some embodiments, the functionality discussed herein with respect to the console 915 may be implemented in the headset 905, or a remote system.

The application store 955 stores one or more applications for execution by the console 915. An application is a group of instructions, that when executed by a processor, generates content for presentation to the user. Content generated by an application may be in response to inputs received from the user via movement of the headset 905 or the I/O interface 910. Examples of applications include: gaming applications, conferencing applications, video playback applications, or other suitable applications.

The tracking module 960 tracks movements of the headset 905 or of the I/O interface 910 using information from the DCA 945, the one or more position sensors 940, or some combination thereof. For example, the tracking module 960 determines a position of a reference point of the headset 905 in a mapping of a local area based on information from the headset 905. The tracking module 960 may also determine positions of an object or virtual object. Additionally, in some embodiments, the tracking module 960 may use portions of data indicating a position of the headset 905 from the position sensor 940 as well as representations of the local area from the DCA 945 to predict a future location of the headset 905. The tracking module 960 provides the estimated or predicted future position of the headset 905 or the I/O interface 910 to the engine 965.

The engine 965 executes applications and receives position information, acceleration information, velocity information, predicted future positions, or some combination thereof, of the headset 905 from the tracking module 960. Based on the received information, the engine 965 determines content to provide to the headset 905 for presentation to the user. For example, if the received information indicates that the user has looked to the left, the engine 965 generates content for the headset 905 that mirrors the user's movement in a virtual local area or in a local area augmenting the local area with additional content. Additionally, the engine 965 performs an action within an application executing on the console 915 in response to an action request received from the I/O interface 910 and provides feedback to the user that the action was performed. The provided feedback may be visual or audible feedback via the headset 905 or haptic feedback via the I/O interface 910.

The network 920 couples the headset 905 and/or the console 915 to the mapping server 925. The network 920 may include any combination of local area and/or wide area networks using both wireless and/or wired communication systems. For example, the network 920 may include the Internet, as well as mobile telephone networks. In one embodiment, the network 920 uses standard communications technologies and/or protocols. Hence, the network 920 may include links using technologies such as Ethernet, 802.11, worldwide interoperability for microwave access (WiMAX), 2G/3G/4G mobile communications protocols, digital subscriber line (DSL), asynchronous transfer mode (ATM), InfiniBand, PCI Express Advanced Switching, etc. Similarly, the networking protocols used on the network 920 can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network 920 can be represented using technologies and/or formats including image data in binary form (e.g. Portable Network Graphics (PNG)), hypertext markup language (HTML), extensible markup language (XML), etc. In addition, all or some of links can be encrypted using conventional encryption technologies such as secure sockets layer (SSL), transport layer security (TLS), virtual private networks (VPNs), Internet Protocol security (IPsec), etc.

The mapping server 925 may include a database that stores a virtual model describing a plurality of spaces, wherein one location in the virtual model corresponds to a current configuration of a local area of the headset 905. The mapping server 925 receives, from the headset 905 via the network 920, information describing at least a portion of the local area and/or location information for the local area. The user may adjust privacy settings to allow or prevent the headset 905 from transmitting information to the mapping server 925. The mapping server 925 determines, based on the received information and/or location information, a location in the virtual model that is associated with the local area of the headset 905. The mapping server 925 determines (e.g., retrieves) one or more acoustic parameters associated with the local area, based in part on the determined location in the virtual model and any acoustic parameters associated with the determined location. The mapping server 925 may transmit the location of the local area and any values of acoustic parameters associated with the local area to the headset 905.

One or more components of system 900 may contain a privacy module that stores one or more privacy settings for user data elements. The user data elements describe the user or the headset 905. For example, the user data elements may describe a physical characteristic of the user, an action performed by the user, a location of the user of the headset 905, a location of the headset 905, an HRTF for the user, etc. Privacy settings (or "access settings") for a user data element may be stored in any suitable manner, such as, for example, in association with the user data element, in an index on an authorization server, in another suitable manner, or any suitable combination thereof.

A privacy setting for a user data element specifies how the user data element (or particular information associated with the user data element) can be accessed, stored, or otherwise used (e.g., viewed, shared, modified, copied, executed, surfaced, or identified). In some embodiments, the privacy settings for a user data element may specify a "blocked list" of entities that may not access certain information associated with the user data element. The privacy settings associated with the user data element may specify any suitable granularity of permitted access or denial of access. For example, some entities may have permission to see that a specific user data element exists, some entities may have permission to view the content of the specific user data element, and some entities may have permission to modify the specific user data element. The privacy settings may allow the user to allow other entities to access or store user data elements for a finite period of time.

The privacy settings may allow a user to specify one or more geographic locations from which user data elements can be accessed. Access or denial of access to the user data elements may depend on the geographic location of an entity who is attempting to access the user data elements. For example, the user may allow access to a user data element and specify that the user data element is accessible to an entity only while the user is in a particular location. If the user leaves the particular location, the user data element may no longer be accessible to the entity. As another example, the user may specify that a user data element is accessible only to entities within a threshold distance from the user, such as another user of a headset within the same local area as the user. If the user subsequently changes location, the entity with access to the user data element may lose access, while a new group of entities may gain access as they come within the threshold distance of the user.

The system 900 may include one or more authorization/privacy servers for enforcing privacy settings. A request from an entity for a particular user data element may identify the entity associated with the request and the user data element may be sent only to the entity if the authorization server determines that the entity is authorized to access the user data element based on the privacy settings associated with the user data element. If the requesting entity is not authorized to access the user data element, the authorization server may prevent the requested user data element from being retrieved or may prevent the requested user data element from being sent to the entity. Although this disclosure describes enforcing privacy settings in a particular manner, this disclosure contemplates enforcing privacy settings in any suitable manner.

Additional Configuration Information

The foregoing description of the embodiments has been presented for illustration; it is not intended to be exhaustive or to limit the patent rights to the precise forms disclosed. Persons skilled in the relevant art can appreciate that many modifications and variations are possible considering the above disclosure.

Some portions of this description describe the embodiments in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all the steps, operations, or processes described.

Embodiments may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the patent rights. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights, which is set forth in the following claims.

What is claimed is:

1. A power management circuit comprising:

a controller circuit for generating a power control signal, the controller circuit configured to receive a set of configuration parameters from a display device and to generate the power control signal based on the set of configuration parameters, wherein the configuration parameters are determined based on at least one of values stored in a look-up table of the display device or an equation stored in a non-volatile memory of the display device, and the configuration parameters specify one or more voltage levels at one or more time points of one or more power supply voltages; and a power supply circuit coupled to an output of the controller circuit, the power supply circuit configured to receive the power control signal from the controller circuit, and to generate the one or more power supply voltages having a waveform based on the power control signal.

2. The power management circuit of claim 1, wherein the controller circuit is further configured to receive display data, and to identify an entry of the look-up table based on the received display data.

3. The power management circuit of claim 2, wherein the display data is received from the display device or from an application processor.

4. The power management circuit of claim 2, wherein the display data is one of video data for a video frame to be displayed by the display device, a brightness level for an image to be displayed by the display device, a frame rate of the display device, a panel temperature of a display panel of the display device, or an on-pixel-ratio (OPR) for the image.

5. The power management circuit of claim 4, wherein the OPR is determined by summing a grayscale level of each pixel of the image.

6. The power management circuit of claim 4, wherein the OPR is indicative of a ratio between an expected brightness of the display panel during a current frame and a maximum brightness of the display panel.

7. The power management circuit of claim 1, wherein the power supply circuit comprises a plurality of voltage regulators, each voltage regulator of the plurality of voltage regulators configured to generate a power supply voltage having a corresponding nominal value.

8. The power management circuit 1, wherein the controller circuit is further configured to:

receive one or more display control signals; and generate the power control signal further based on the received one or more display control signals.

9. The power management circuit of claim 8, wherein the one or more display control signals include at least one of a vertical synchronization signal and a frame rate of the display device.

10. The power management circuit of claim 9, wherein the one or more display control signals are received from the display device or from an application processor.

11. A method, comprising:

receiving, by a controller circuit, a set of configuration parameters from a display device, wherein the configuration parameters are determined based on at least one of values stored in a look-up table of the display device or an equation stored in a non-volatile memory of the display device, and the configuration parameters specify one or more voltage levels at one or more time points of one or more power supply voltages;

generating a power control signal based at least in part on the received configuration parameters; and generating, by a power supply circuit, the one or more power supply voltages having a waveform based on the power control signal.

12. The method of claim 11, further comprising:

receiving display data; and identifying an entry of the look-up table based on the received display data.

13. The method of claim 12, wherein the display data is received from the display device or from an application processor.

14. The method of claim 12, wherein the display data is one of video data for a video frame to be displayed by the display device, a brightness level for an image to be displayed by the display device, a frame rate of the display device, a panel temperature of a display panel of the display device, or an on-pixel-ratio (OPR) for the image.

15. The method of claim 14, wherein the OPR is determined by summing a grayscale level of each pixel of the image.

16. The method of claim 14, wherein the OPR is indicative of a ratio between an expected brightness of the display panel during a current frame and a maximum brightness of the display panel.

17. The method of claim 11, further comprising:

receiving, by the controller circuit, one or more display control signals, wherein the one or more display control signals include at least one of a vertical synchronization signal, a horizontal synchronization signal, and a frame rate of the display device; and generating the power control signal further based on the received one or more display control signals.

18. A method, comprising:

providing a test image for display to a display device;

providing, to the display device, a set of power supply voltages having a waveform generated based on a power profile;

capturing an output of a display panel of the display device, the output based on the test image and the set of power supply voltages having the waveform; and responsive to determining that the output of the display panel meets a predetermined threshold, storing the power profile in a look-up table of the display device, the power profile including information about a plurality of configuration parameters that specify a plurality of voltage levels at a plurality of time points of the power supply voltages.

19. The method of claim 18, further comprising:

responsive to determining that the output of the display panel does not meet the predetermined threshold, modifying the power profile;

providing, to the display device, the set of power supply voltages having a second waveform generated based on the modified power profile;

capturing a modified output of the display panel, the modified output based on the test image and the set of power supply voltages having the second waveform; and responsive to determining that the modified output of the display panel meets the predetermined threshold, storing the modified power profile in the look-up table.

20. The method of claim 18, wherein the output of the display panel is one of an image of the display panel captured using a camera, a voltage waveform at a plurality of probe points of the display panel, and a current waveform at the plurality of probe points of the display panel.

* * * * *